US009248987B2

(12) United States Patent
Hatano

(10) Patent No.: US 9,248,987 B2
(45) Date of Patent: Feb. 2, 2016

(54) RECORDING MEDIUM CONVEYANCE APPARATUS, IMAGE FORMING APPARATUS, RECORDING MEDIUM CONVEYANCE METHOD AND RECORDING MEDIUM STORING PROGRAM OF RECORDING MEDIUM CONVEYANCE METHOD

(71) Applicant: Takashi Hatano, Kanagawa (JP)

(72) Inventor: Takashi Hatano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 26 days.

(21) Appl. No.: 14/047,286

(22) Filed: Oct. 7, 2013

(65) Prior Publication Data

US 2014/0119804 A1 May 1, 2014

(30) Foreign Application Priority Data

Oct. 31, 2012 (JP) ..... 2012-240240

(51) Int. Cl.
*B65H 19/00* (2006.01)
*B65H 16/00* (2006.01)
*B65H 26/06* (2006.01)

(52) U.S. Cl.
CPC ..... *B65H 16/00* (2013.01); *B65H 19/00* (2013.01); *B65H 26/06* (2013.01); *B65H 2301/41522* (2013.01); *B65H 2404/143* (2013.01); *B65H 2511/114* (2013.01); *B65H 2553/51* (2013.01); *B65H 2801/36* (2013.01)

(58) Field of Classification Search
CPC ..... B65H 19/00; B65H 19/28; B65H 19/29; B65H 19/2261; B65H 19/2207; B65H 23/00; B65H 23/044; B65H 23/004; B65H 23/182; B65H 23/1825
See application file for complete search history.

(56) References Cited

U.S. PATENT DOCUMENTS

| | | | | |
|---|---|---|---|---|
| 5,708,911 | A * | 1/1998 | Kageyama et al. | 399/23 |
| 6,091,928 | A * | 7/2000 | Fuchisawa | 399/384 |
| 6,874,725 | B1 * | 4/2005 | Woosley et al. | 242/600 |
| 7,018,118 | B1 * | 3/2006 | Woosley et al. | 400/242 |
| 7,588,300 | B2 * | 9/2009 | Koga et al. | 347/5 |
| 8,090,308 | B2 * | 1/2012 | Itoh | 399/385 |
| 2002/0100832 | A1 * | 8/2002 | Hanson | 242/532.3 |
| 2006/0066647 | A1 * | 3/2006 | Koga et al. | 347/5 |
| 2008/0187380 | A1 * | 8/2008 | Fukuda | 399/364 |
| 2011/0013962 | A1 * | 1/2011 | Montagutelli | 400/613 |
| 2011/0164913 | A1 * | 7/2011 | Tsugaru et al. | 400/582 |

FOREIGN PATENT DOCUMENTS

| | | |
|---|---|---|
| JP | 07-253695 | 10/1995 |
| JP | 2002-302313 | 10/2002 |
| JP | 2008-001482 | 1/2008 |

* cited by examiner

*Primary Examiner* — David Banh
(74) *Attorney, Agent, or Firm* — Duft Bornsen & Fettig LLP

(57) ABSTRACT

A recording medium conveyance apparatus includes a feeding unit for accommodating a roll pipe and feeding a recording medium, a conveyance unit for conveying the recording medium fed by the feeding unit, and a determination unit for determining an accommodation state of the recording medium accommodated in the feeding unit. The feeding unit includes a driving unit for rotating the roll pipe and a detection unit for detecting a rotational operation of the roll pipe. The conveyance unit, using at least two rollers, conveys or fixes the recording medium by nipping it with the rollers. The determination unit, based on the rotational operation of the roll pipe detected by the detection unit when the recording medium is fixed by the rollers, determines whether the recording medium is fixed to the roll pipe or not.

14 Claims, 6 Drawing Sheets

RECORDING MEDIUM CONVEYANCE APPARATUS, IMAGE FORMING APPARATUS, RECORDING MEDIUM CONVEYANCE METHOD AND RECORDING MEDIUM STORING PROGRAM OF RECORDING MEDIUM CONVEYANCE METHOD

RELATED APPLICATIONS

The present application claims priority to and incorporates by reference the entire contents of Japanese Patent Application No. 2012-240240 filed in Japan on Oct. 31, 2012.

BACKGROUND OF THE INVENTION

1. Field of the Invention

The disclosures herein generally relate to a recording medium conveyance apparatus, an image forming apparatus and a recording medium conveyance method.

2. Description of the Related Art

In apparatuses such as image forming apparatuses in which a recording medium is used, a recording medium may be conveyed by rotating two rollers (roller pair) while the recording medium is nipped between the two rollers. Also, in image forming apparatuses, images may be formed on a surface of a long recording medium, the recording medium is cut off after forming the images, and the image formed cut-off part of the recording medium is discharged (ejected).

In Patent Document 1, a technology is disclosed, which is related to a recording apparatus capable of detecting existence or non-existence of slack of a roll of paper, or detecting a remaining amount of the roll of paper in accordance with a conveyance method.

[Patent Document 1] Japanese Patent Application Publication No. 2002-302313

SUMMARY OF THE INVENTION

A long recording medium (e.g., roll of paper) is rolled around a roll pipe (e.g., paper pipe for a roll paper) and installed in an image forming apparatus. Also, the installed long recording medium is fed to (rolled out to) the image forming apparatus continuously from a front end of the medium by the rotation of the roll pipe. Furthermore, the long recording medium is rolled back again and restored by a reverse rotation of the roll pipe.

In the technology disclosed in Patent Document 1, a long recording medium in some instances cannot be rolled back when restoring the recording medium after forming images. In the technology disclosed in Patent Document 1, for example, the rear end of the recording medium may be detached from the roll pipe, or there may be slack in the roll of the recording medium around the roll pipe. In such a case, the recording medium cannot be rolled back. Also, in the technology disclosed in Patent Document 1, an erroneous detection such as a paper jam detection may be made when the recording medium cannot be rolled back.

It is a general object of at least one embodiment of the present invention to provide a recording medium conveyance apparatus, an image forming apparatus or a method of recording medium conveyance that is configured to determine whether a rear end of a recording medium is fixed to a roll pipe or not by detecting a rotational operation of a roll pipe of an upstream side in a conveyance direction when the recording medium is held still at a downstream side.

According to an embodiment of the present invention, a recording medium conveyance apparatus for conveying a recording medium rolled around a roll pipe is provided, which recording medium conveyance apparatus includes a feeding unit configured to accommodate the roll pipe and feed the recording medium, a conveyance unit configured to convey the recording medium fed by the feeding unit and a determination unit configured to determine an accommodation state of the recording medium accommodated by the feeding unit. The feeding unit includes a driving unit configured to rotate the roll pipe and a detection unit configured to detect a rotational operation of the roll pipe. The conveyance unit, using at least two rollers, nips the recording medium with the rollers and conveys or holds still the recording medium. The determination unit determines whether the recording medium is fixed to the roll pipe based on the rotational operation of the roll pipe detected by the detection unit when the recording medium is held still by the rollers.

According to another embodiment of the present invention, an image forming apparatus is provided, which image forming apparatus includes the above conveyance apparatus and an image forming unit configured to form an image on the recording medium.

According to yet another embodiment of the present invention, a method of recording medium conveyance is provided, which method includes a feeding step of feeding a recording medium rolled around a roll pipe, a restoration step of restoring the fed recording medium, and a determination step of determining an accommodation state of the recording medium. In the feeding step, by rotating the roll pipe, the recording medium is fed continuously from the front end in the conveyance direction. In the restoration step, the downstream side of the fed recording medium is fixed, the recording medium is restored by reversely rotating the roll pipe, and a rotational operation of the roll pipe during the restoration is detected. In the determination step, it is determined whether the recording medium is fixed to the roll pipe based on the rotational operation of the roll pipe detected in the restoration step.

According to a recording medium conveyance apparatus, an image forming apparatus or a method of recording medium conveyance, it can be determined whether a rear end of a recording medium is fixed to a roll pipe or not by detecting a rotational operation of a roll pipe of an upstream side when the recording medium is fixed at a downstream side.

BRIEF DESCRIPTION OF THE DRAWINGS

Other objects and further features of embodiments will become apparent from the following detailed description when read in conjunction with the accompanying drawings.

DESCRIPTION OF THE PREFERRED EMBODIMENTS

Figure 1:
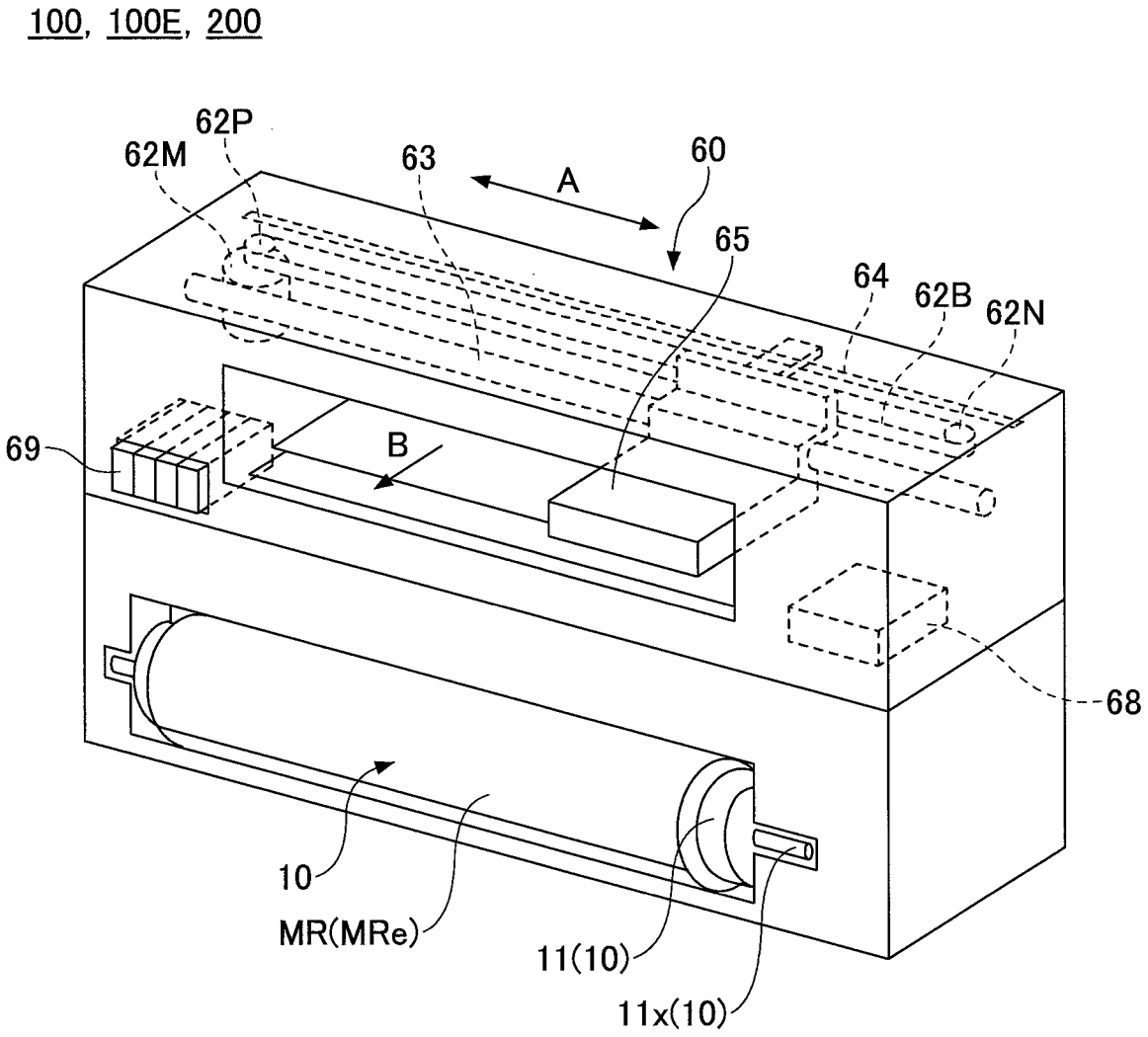
FIG. 1 is a drawing illustrating an overview of an example of a recording medium conveyance apparatus according to an embodiment of the present invention.

In the following, embodiments of the present invention will be described with reference to the accompanying drawings.

An embodiment of the present invention will be described using a conveyance apparatus that conveys a long recording medium rolled around a roll pipe. The present invention can be applied to, other than a conveyance apparatus described in the following, a medium feeding apparatus, a feeding tray detection apparatus, a conveying medium detection apparatus, an image forming apparatus, a recording apparatus, a copy machine, a multifunction machine, a printer, a scanner, a plotter, a facsimile, a fax machine, or anything (apparatus, device, unit, etc.) that uses a long recording medium. Also, regarding the recording medium that can be conveyed by a conveyance apparatus according to the present embodiment, it includes a long paper, a long sheet, a long thin paper, a long thick paper, a long recording sheet, a long OHP sheet, a long synthetic resin film, a long metal thin film, and other long media.

Note that in the following description, the same or a corresponding reference numeral is used for the same or a corresponding member or unit throughout the accompanying drawings, and duplicated descriptions will be omitted for the same or a corresponding member or unit. Also, in the following description, a long recording medium will be simply referred to a recording medium. Furthermore, a size of a member or unit shown in the drawings is not intended for showing a ratio to a size of other members or units. Therefore, actual sizes can be determined by a person skilled in the art in accordance with the following embodiments.

Using a recording medium conveyance apparatus according to an embodiment of the present invention, the present embodiments will be described in the following order.

1. Configuration of conveyance apparatus
2. Conveyance operations
3. Program of conveyance method and recording medium
4. First embodiment (conveyance apparatus)
5. Second embodiment (image forming apparatus including the conveyance apparatus)

Configuration of Conveyance Apparatus

Using FIG. 1 through FIG. 3, a configuration of a recording medium conveyance apparatus (hereinafter, referred to as a conveyance apparatus 100) according to the present embodiment will be described.

Figure 2:
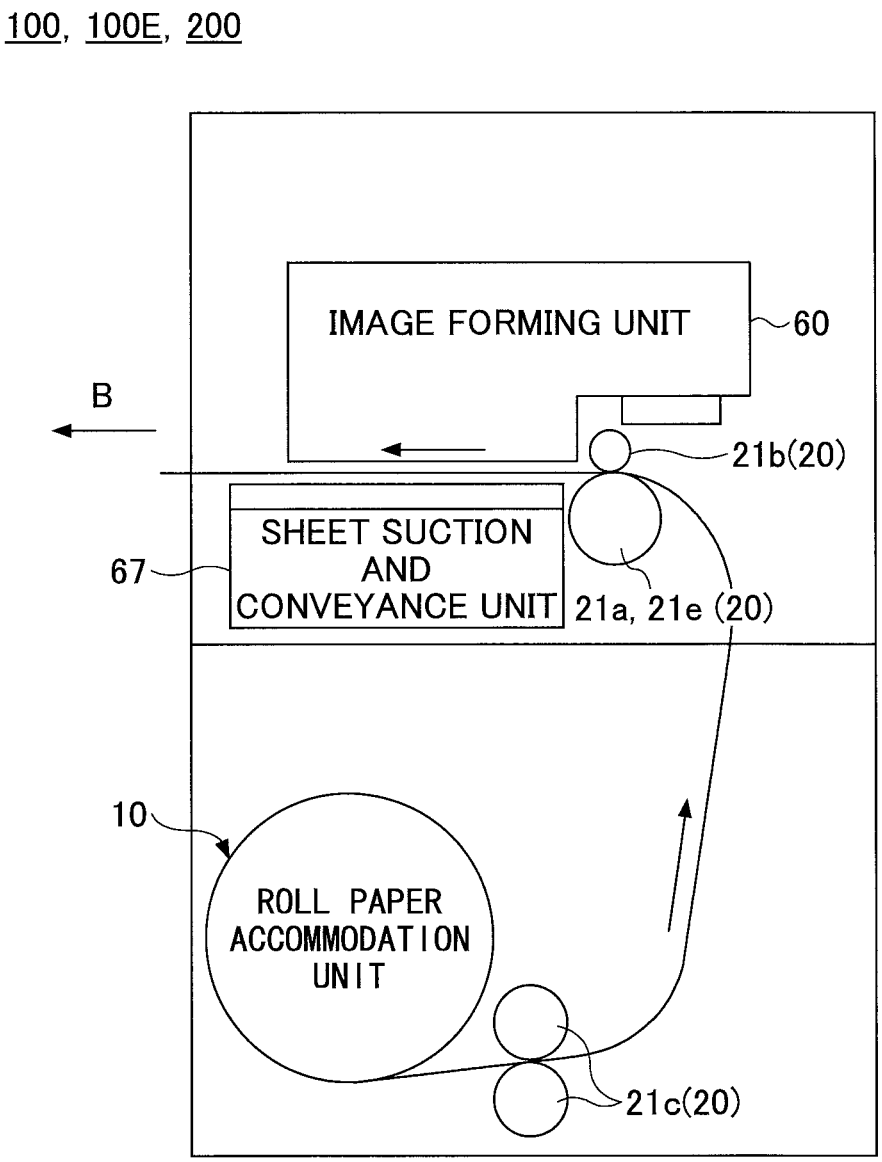
FIG. 2 is a drawing illustrating a cross-sectional view of an example of a recording medium conveyance apparatus according to an embodiment of the present invention.

As shown in FIG. 1 and FIG. 2, the conveyance apparatus 100 includes a feeding unit 10 configured to feed a recording medium MR rolled around a roll pipe 11, and a conveyance unit 20 configured to convey the recording medium MR fed by the feeding unit 10. Also, the conveyance apparatus 100 includes a determination unit (not shown in the figures) configured to determine an accommodation state of the recording medium MR accommodated by the feeding unit 10. Furthermore, the conveyance apparatus 100 can include an input unit and an output unit (not shown in the figures) configured to output and input information to and from outside the conveyance apparatus 100. Note that the conveyance apparatus 100 may also include a control unit (not shown in the figure) configured to control operations of the conveyance apparatus 100.

The conveyance apparatus 100, using the feeding unit 10 (roll pipe, driving unit, etc.), accommodates the recording medium MR and feeds the recording medium MR to a conveyance unit 20. Also, the conveyance apparatus 100, using the conveyance unit 20 (conveyance roller, etc.), conveys (moves, moves in, moves out, nips, holds still, etc.), the recording medium MR. Furthermore, the conveyance apparatus 100, using the determination unit, determines the accommodation state of the recording medium MR accommodated by the feeding unit 10. Note that the accommodation state refers to an arrangement state (e.g., rolling state) of the recording medium MR rolled around the roll pipe 11 of the feeding unit 10.

The feeding unit 10 is a unit for feeding the recording medium MR. The feeding unit 10 includes the roll pipe 11 for rolling and retaining the recording medium MR, a driving unit 12 for rotating the roll pipe 11, and a detection unit 13 for detecting a rotational operation of the roll pipe 11.

The roll pipe 11 is for rolling and retaining the recording medium (long recording medium) MR. The roll pipe 11 can use a member (e.g., paper pipe, cylinder pipe, circular cylinder, etc.) around which the long recording medium MR can be rolled. Regarding the roll pipe 11, a spool axle 11*x* (see FIG. 1 and FIG. 3) is detachably placed in the conveyance apparatus 100. By this, a user, after using the rolled recording medium MR, can exchange the used roll pipe with a new roll pipe around which a new recording medium MR is rolled.

Note that the roll pipe 11 can retain a recording medium MR (roll of paper, etc.) of a different size in terms of width or in terms of axis direction (a direction shown in "A" in FIG. 1). Also, the roll pipe 11 may include flanges for holding both ends of the roll of recording medium MR.

The driving unit 12 is for feeding the recording medium MR retained by the roll pipe 11 to the conveyance unit 20 (described later) continuously from an end (front end) of the recording medium MR by rotating the roll pipe 11 (forward rotation). The driving unit 12 is, also, for rolling back (restoring) the recording medium MR fed to the conveyance unit 20 by rotating the roll pipe 11 (backward rotation). Here, the driving unit 12 can, for example, using a driving force of a motor (not shown in the figure), rotate the roll pipe 11 (or flanges) in the forward direction or in the backward direction by rotating the spool axle 11*x*. Furthermore, in this embodiment, the driving unit 12 includes a clutch member 12*c* for transmitting power to the roll pipe 11.

The clutch member 12*c* transmits the power of the motor to the roll pipe 11 (or the spool axle 11*x*) in the case where the roll pipe 11 can be driven with less than a certain amount of power, and does not transmit the power of the motor to the roll pipe 11 in the case where the roll pipe 11 cannot be driven with less than a certain amount of power. By this, the driving unit 12 (the conveyance apparatus 100) can control the rotational operation of the roll pipe 11.

Figure 3:
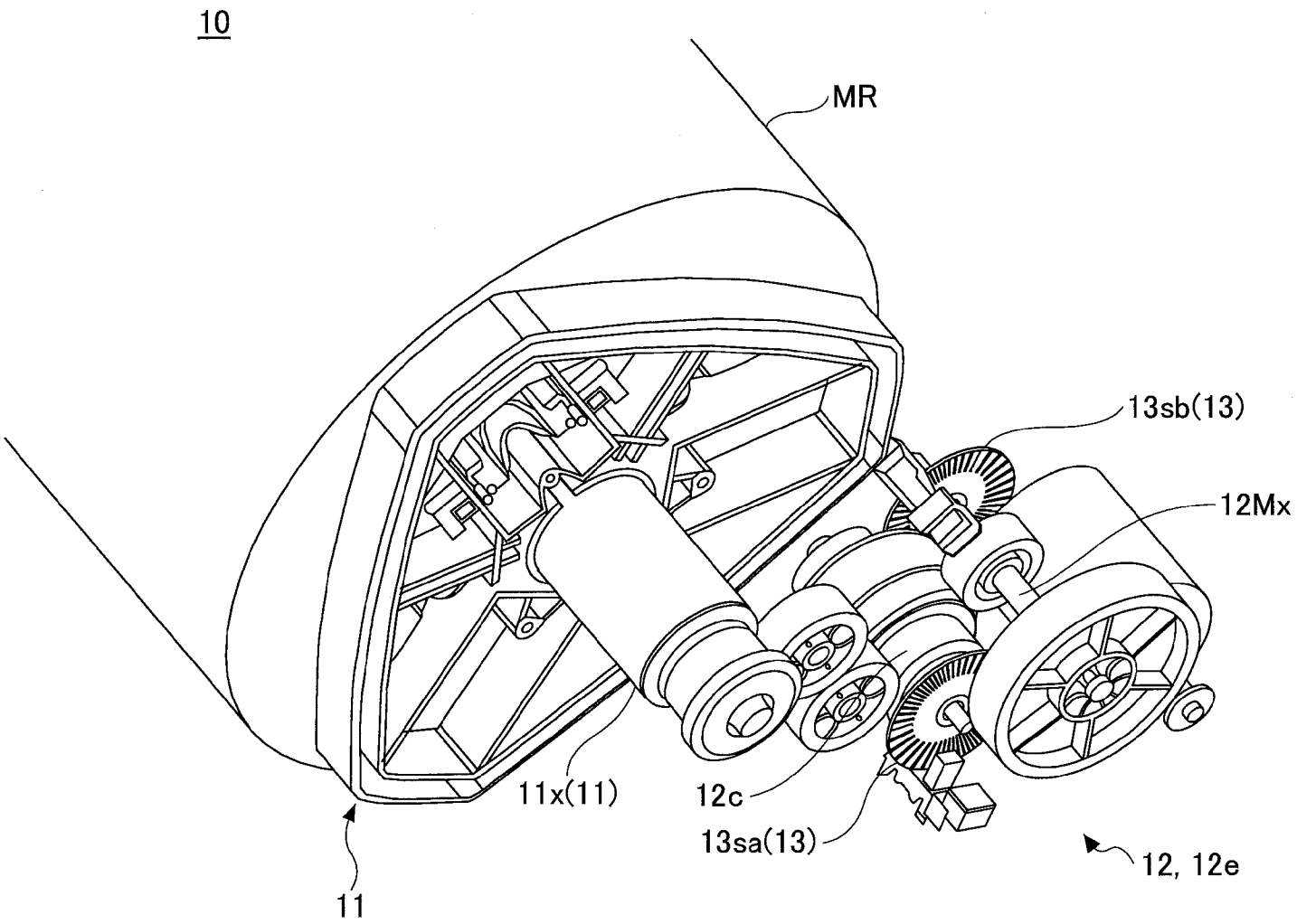
FIG. 3 is a drawing illustrating an example of a feeding unit of a recording medium conveyance apparatus according to an embodiment of the present invention.

To be more precise, as shown in FIG. 3, the clutch member 12*c* connects the spool axle 11*x* of the roll pipe 11 to a driving axle 12Mx of the motor via gears (toothed wheels), etc. Also, the clutch member 12*c* locks in the direction (backward direction, or restoring direction) for rolling back the recording medium MR, and does not lock in the forward direction (conveyance direction). That is, in the case where the driving unit 12 rolls back the recording medium MR, when more than the certain amount of power is required for rotating the roll pipe 11, the clutch member 12*c* does not transmit the power of the motor to the roll pipe 11 by freeing the power in the forward direction. By this, the driving unit 12, in the case of rolling back the recording medium MR, can perform control of not rotating (rotating backward) (restoring) the roll pipe 11.

Here, the certain amount of power can take any value corresponding to the type (thickness) of the recording medium MR and the specification of the feeding unit 10 (or the roll pipe 11). Also, the certain amount of power can take a value further corresponding to other specifications of the conveyance apparatus 100. Furthermore, the certain amount of power can take a value predefined based on an experiment, a calculation, etc.

Furthermore, the driving unit 12 may include a torque limiter. By this, the driving unit 12 can convey (feed or restore) the recording medium MR while applying a tensional force (applying a backward tension) to the recording medium MR. Also, in the case where the conveyance apparatus 100 is installed in an image forming apparatus, the conveyance apparatus 100 can, by transmitting the power using the torque limiter, avoid slack of the recording medium MR when repeating a discontinuous conveyance. Furthermore, in the case where the conveyance apparatus is installed in an image forming apparatus, the conveyance apparatus 100 can, by transmitting the power using the torque limiter, avoid slack of the recording medium MR when rolling back the recording medium MR by a resist roller (to be described later).

The detection unit 13 is for detecting the rotational operation of the roll pipe 11. The detection unit 13 detects as a rotational operation of the roll pipe 11, for example, a number of rotations of the spool axle 11*x* of the roll pipe 11. Also, the detection unit 13 may further detect, for example, a number of rotations of the motor of the driving unit 12.

To be more precise, as shown in FIG. 3, the detection unit 13 can, by using an encoder 13*sa*, detect a number of rotations of the spool axle 11*x* of the roll pipe 11. Also, the detection unit 13 may, by using an encoder 13*sb*, detect a number of rotations of the driving axle 12Mx of the driving unit 12. Note that regarding the detection unit 13, a photo sensor, a rotary encoder, an encoder sensor, an optical sensor, a magnetic sensor, an electrostatic sensor, a direct acting type sensor, a motor built-in rotational phase detector, etc., can be used.

Also, the conveyance apparatus 100 can, based on a detection result detected by the encoder 13*sa* and the encoder 13*sb*, control a rotational operation of the roll pipe 11 and the operation of the motor. Also, the conveyance apparatus 100 can, based on a detection result detected by the encoder 13*sb* placed in the upstream side of the clutch member 12*c* and the encoder 13*sa* placed in the downstream side, control the operation of the clutch member 12*c*.

Furthermore, in the case where the conveyance unit 20 to be described later (conveyance roller) holds still the recording medium MR, when the driving unit 12 rotates the spool axle 11*x* and restores the recording medium MR, the detection unit 13 detects a number of rotations of the spool axle 11*x*. Also, the detection unit 13 may start the detection of the rotational operation of the roll pipe 11 (e.g., a number of rotations of the spool axle 11*x*) a predefined period of time after the driving unit 12 rotates the spool axle 11*x*. By this, the detection unit 13 (the conveyance apparatus 100) can further accurately detect the rotational operation of the roll pipe 11 because disturbances such as slack of the recording medium MR, etc., can be eliminated.

Here, the predefined period of time can be a period corresponding to specifications of a type of the recording medium MR and/or the feeding unit 10. Also, the predefined period of time can be a period corresponding to other specifications of the conveyance apparatus 100. Furthermore, the predefined period of time can be a period defined in advance by an experiment or a calculation, etc. The predefined period of time can be, for example, a second or two seconds.

The conveyance unit 20 is a unit for moving (conveying) or holding still the recording medium MR. The conveyance unit 20, by using the conveyance rollers 21*a* and 21*b* (correspond to the "two rollers" in the claims), conveys or holds still the recording medium MR. Note that the conveyance unit 20 may convey or hold still the recording medium MR by using two or more rollers.

To be more precise, as shown in FIG. 2, the conveyance unit 20 uses, as the conveyance rollers, a driving roller (resist roller) 21*a* and a following roller (pressurized roller) 21*b*. Also, the conveyance unit 20 may further use, as the conveyance rollers, a roller pair 21*c*. The conveyance unit 20 is capable of, having the recording medium MR nipped between the driving roller 21*a* and the following roller 21*b*, by rotating the driving roller 21*a* in the forward direction (forward rotation), conveying the recording medium MR in the conveyance direction. Also, the conveyance unit 20 is capable of, having the recording medium MR nipped between the driving roller 21*a* and the following roller 21*b*, by rotating the driving roller 21*a* in the reverse direction, conveying the recording medium MR in the reverse direction (hereinafter, referred to as "restoring direction"). Furthermore, the conveyance unit 20 is capable of, having the recording medium MR nipped between the driving roller 21*a* and the following roller 21*b*, by stopping the driving roller 21*a*, holding still the recording medium MR. That is, the conveyance unit 20 is capable of, by using the driving roller 21*a*, etc., conveying or holding still the recording medium MR.

The determination unit is a unit for determining the accommodation state of the recording medium MR. The determination unit determines the accommodation state of the recording medium MR retained by the roll pipe 11 of the feeding unit 10 based on a detection result detected by the detection unit 13 of the feeding unit 10. The determination unit can determine whether the recording medium MR is fixed to (retained by, remaining on, etc.) the roll pipe 11 or not based on the rotational operation of the roll pipe 11 detected by the detection unit 13. Also, the determination unit can determine whether the recording medium MR is fixed, etc., to the roll pipe 11 (or flanges) based on the number of rotations of, for example, the spool axle 11*x* (or flanges) of the roll pipe 11 detected by the detection unit 13.

To be more precise, the determination unit, in the case where the recording medium MR is held still by the driving roller 21*a*, regarding the rotational operation of the roll pipe 11 detected by the detection unit 13, determines that the recording medium MR is fixed to the roll pipe 11 when the number of rotations of the spool axle 11*x* is less than a predefined number of rotations. By this, the determination unit (the conveyance apparatus 100) can determine the accommodation state of the recording medium MR (e.g., the state of the rear end of the recording medium MR) in accordance with the specifications or the characteristics of the conveyance apparatus 100. Note that the determination unit may determine whether the recording medium MR is fixed, etc., to the roll pipe 11, by further using information (e.g., information on the types, etc., of the recording medium MR, information on a threshold value) inputted by an input unit (described later).

Here, it can be assumed that the predefined number of rotations is a number of rotations corresponding to the specifications of the feeding unit 10 (or the roll pipe 11 or the flanges). Also, it can be assumed that the predefined number of rotations is a number of rotations further corresponding to other specifications of the conveyance apparatus 100. Furthermore, it can be assumed that the predefined number of rotations is a number of rotations defined in advance based on an experiment or a calculation.

The input unit is a unit for inputting information (e.g., electrical signals) from outside the conveyance apparatus 100. The input unit inputs information related to operations of the conveyance apparatus 100 from an external apparatus (PC, etc.) The input unit can input, for example, a predefined period of time before the detection unit 13 starts the detection and/or a predefined number of rotations that is used when the determination unit makes the determination.

The output unit is a unit for outputting information (e.g., electrical signals) to outside the conveyance apparatus 100. The output unit outputs information related to operations of the conveyance apparatus 100 to an external apparatus (PC, etc.) The output unit can output, for example, an accommodation state determined by the determination unit and/or a conveyance result of the conveyance unit 20 when the conveyance unit 20 conveys the recording medium MR by reversely rotating the driving roller (resist roller) 21*a*.

The input unit and the output unit can include an input member (e.g., a user interface such as an operation panel) to which information (information on the recording medium MR, etc.) is inputted. Also, the input unit and the output unit can include an output member (e.g., a display member such as a touch panel) with which information is outputted (displayed) outside the conveyance apparatus 100.

A control unit is a unit for instructing components of the conveyance apparatus 100 to operate and controlling the components' operations. The control unit controls operations of feeding and restoring the recording medium MR by controlling the operations of the feeding unit 10. Also, the control unit controls operations of conveying (moving, moving in, moving out, nipping, holding still, etc.) the recording medium MR by controlling the operations of the conveyance unit 20. Also, the control unit controls operations of determining the accommodation state of the recording medium MR accommodated by the feeding unit 10 by controlling the operations of the determination unit. The control unit further controls operations of inputting and outputting information between the conveyance apparatus 100 and outside the conveyance apparatus 100 by controlling the operations of the input unit and the output unit.

Note that the control unit may be configured to be a processor including a CPU (Central Processing Unit) of known technology, a memory, etc. Also, the control unit, using, for example, a program (control program, application, etc.) stored in advance, may control the operations of the components of the conveyance apparatus 100. The control unit may, further based on information, etc., inputted from the input unit, control the operations of the components of the conveyance apparatus 100.

Operations of Conveyance

An example of operations of the conveyance apparatus according to the present embodiment will be described.

The conveyance apparatus 100 (FIG. 1 through FIG. 3), in a feeding step, feeds the recording medium MR accommodated by the roll pipe 11, around which the recording medium MR is rolled. Next, the conveyance apparatus 100, in a conveyance step, conveys the fed recording medium MR in the conveyance direction.

Also, the conveyance apparatus 100, in a restoration step, restores the fed recording medium MR. At this time, the conveyance apparatus 100, in a determination step, determines the accommodation state of the accommodated recording medium MR.

To be more precise, in the feeding step, the recording medium MR is fed continuously from a front end of the recording medium MR in the conveyance direction by rotating the roll pipe 11 (forward rotation) using the driving unit 12. Next, in the conveyance step, the recording medium MR is moved in the conveyance direction by using the driving roller 21*a*, etc.

In the restoration step, by using the driving roller 21*a*, etc., the recording medium MR is held still at the downstream side. Next, by reversely rotating the roll pipe 11 by using the driving unit 12, the recording medium MR is restored to the feeding unit 10. At this time, the feeding unit 10 detects the rotational operation of the roll pipe 11 during the restoration by using the detection units 13*sa*, 13*sb*. Next, in the determination step, by using the determination unit, based on the rotational operation of the roll pipe 11 detected in the restoration step, it is determined whether the recording medium MR is fixed to the roll pipe 11 or not.

In the determination step, regarding the rotational operation of the roll pipe 11 detected by the detection units 13*sa*, 13*sb*, when a number of rotations of the spool axle 11*x* (the roll pipe 11) is less than a predefined number of rotations, it can be determined that the recording medium MR is fixed to the roll pipe 11.

Also, in the restoration step, in the case where it is determined that the recording medium MR is fixed to the roll pipe 11, the speed of restoring (rewinding) the recording medium MR by rotating (reverse rotation) the roll pipe 11 is caused to be greater than the speed of conveying the recording medium MR by rotating (reverse rotation) the conveyance rollers 21*a* and 21*b* or 21*c*. By this, the feeding unit 10 (the conveyance apparatus 100) can reduce the occurrence of a paper jam caused by the pushing from the downstream side.

On the other hand, in the case where the determination unit determines that the recording medium MR is not fixed to the roll pipe 11, the recording medium MR is conveyed in the conveyance direction by rotating (forward rotation) the conveyance rollers 21*a*, 21*b*. At this time, the conveyance unit 20 causes the speed of conveying the recording medium MR by rotating (forward rotation) the conveyance rollers 21*a*, 21*b* to be greater than the speed of feeding (discharging) the recording medium MR by rotating (forward rotation) the roll pipe 11 by the driving unit 12. By this, the conveyance unit 20 (the conveyance apparatus 100) can reduce the occurrence of a paper jam caused by the pushing from the upstream side.

Furthermore, the conveyance apparatus 100 may, as an output step, using the output unit, output the determination result determined by the determination unit. By this, the conveyance apparatus 100 can inform a user about the reason of discharging the recording medium MR (e.g., the rear end of the recording medium MR is not fixed).

Program and Recording Medium in which the Program is Recorded

According to a program of a conveyance method of the present embodiment, a method of recording medium conveyance is executed, which method includes a feeding step of feeding a recording medium accommodated by being rolled around a roll pipe, a restoration step of restoring the fed recording medium, and a determination step of determining an accommodation state of the accommodated recording medium. In the feeding step, the recording medium is fed continuously from the front end of the recording medium in the conveyance direction. In the restoration step, the downstream side of the fed recording medium is held still, the recording medium is restored by reversely rotating the roll pipe, and rotational operation of the roll pipe during the restoration is detected. In the determination step, based on the rotational operation of the roll pipe detected in the restoration, it is determined whether the recording medium is fixed to the roll pipe. According to this configuration, effects equivalent to the conveyance apparatus 100 of the present embodiment can be obtained.

Also, an embodiment of the present invention may be a computer readable recording medium Md in which the above program is recorded. Regarding the recording medium Md in which the above program is recorded, a flexible disk (FD), a CD-ROM (Compact Disk-ROM), a CD-R (CD Recordable), a DVD (Digital Versatile Disk), other computer readable media, a semiconductor memory such as a flash memory, a RAM, a ROM, etc., a memory card, a HDD (Hard Disk Drive), and other computer readable media can be used.

As described above, according to the conveyance apparatus 100 of the recording medium of the present embodiment, by using the feeding unit 10, the conveyance unit 20 and the determination unit, the rotational operation of the roll pipe 11 of the upstream side when the recording medium MR is fixed at the downstream side can be detected. Also, it can be determined whether the rear end of the recording medium MR is fixed to the roll pipe 11 because the rotational operation of the roll pipe 11 of the upstream side when the recording medium MR is fixed at the downstream side can be detected. Furthermore, it can be selected whether to restore the recording medium MR back to the feeding unit 10 or to discharge the recording medium MR by using the conveyance unit 20 because it can be determined whether the rear end of the recording medium MR is fixed to the roll pipe 11 or not.

Also, the state of the rear end of the recording medium MR can be determined without conveying the recording medium MR because it can be determined whether the rear end of the recording medium MR is fixed to the roll pipe 11 or not by using the determination unit, etc. Also, because the state of the rear end of the recording medium MR can be determined, a conveyance route of the recording medium MR can be released and a limitless paper feeding (feeding another recording medium MR successively) can be provided. Furthermore, taking into consideration slack of the recording medium MR (roll paper, etc.) that occurs after the end of conveyance, whether it is possible to rewind the recording medium MR onto the roll pipe 11 or not can be determined just before the rewinding. Therefore, a switching operation can be executed in which the rewinding is performed when it is possible to do the rewinding and the rewinding is stopped and the discharging in the downstream direction is performed when it is not possible to do the rewinding. By this, it becomes possible to reduce unnecessary paper jam occurrences (to reduce jam removing work, to reduce machine damage due to jams, and to reduce down time due to jams).

Also, the state of the rear end of the recording medium MR can be accurately determined because it can be determined whether the rear end of the recording medium MR is fixed to the roll pipe 11 or not by using the determination unit, etc. Also, because the state of the rear end of the recording medium MR can be accurately determined, unnecessary jam occurrences can be avoided, user's workload for the after-treatment is reduced, and/or the down time can be reduced.

Also, because the state of the rear end of the recording medium can be determined, it is not necessary to place a sensor in the conveyance route as opposed to "a method of detecting the state of the rear end using a sensor placed in the conveyance route". Also, because the state of the rear end of the recording medium MR can be determined by using the determination unit, etc., the state of the rear end of the recording medium can be determined even when the recording medium is a medium (e.g., transparent medium) that cannot be detected by a sensor (e.g., optical sensor). That is, the number of components of the apparatus can be reduced, the structure of the apparatus can be simplified and the apparatus can be downsized. Note that in the case where the conveyance apparatus 100 is installed in an image forming apparatus, etc., the conveyance apparatus 100 may be configured to include a sensor placed in the conveyance route, and the front end of the recording medium MR (e.g., whether the recording medium is conveyed to the place where the sensor is placed) can be detected, or the conveyance state (e.g., the rear end) of the recording medium that is conveyed in the conveyance direction (downstream direction) can be detected.

Furthermore, chronological changes of the recording medium MR due to a change of temperature and moisture can be taken into consideration as opposed to a "method detecting from a change of an encoder of a roll paper pipe or a feeding motor (abrupt increase, spinning around)".

EMBODIMENTS

The present invention will be described using embodiments of a recording medium conveyance apparatus and an image forming apparatus including the recording medium conveyance apparatus.

First Embodiment

The present invention will be described using a conveyance apparatus 100E of a first embodiment.

Configuration of the Conveyance Apparatus

A configuration of the conveyance apparatus 100E according to the present embodiment is shown in FIG. 1 through FIG. 3. Here, the configuration of the conveyance apparatus 100E is basically the same as that of the conveyance apparatus 100, and the description is omitted. Note that in this embodiment, the conveyance apparatus 100E uses, as the recording medium MR, a roll paper MRe. Also, the conveyance apparatus 100E uses, as the roll pipe 11, a roll paper pipe 11*e*. Also, the conveyance apparatus 100E uses, as the driving unit 12, a paper feeding motor 12*e*. Furthermore, the conveyance apparatus 100E uses, as a driving unit of the conveyance rollers 21*c*, a resist motor 21*e*.

Conveyance Operations

An example of operations of conveying the roll paper MRe by the conveyance apparatus 100E will be described using FIG. 4, FIGS. 5A, 5B and 5C. In the following, in the case where the conveyance apparatus 100E is installed in an image forming apparatus, operations of rewinding the roll paper MRe to a standby position in order to release an image forming unit after forming the image are described.

Figure 4:
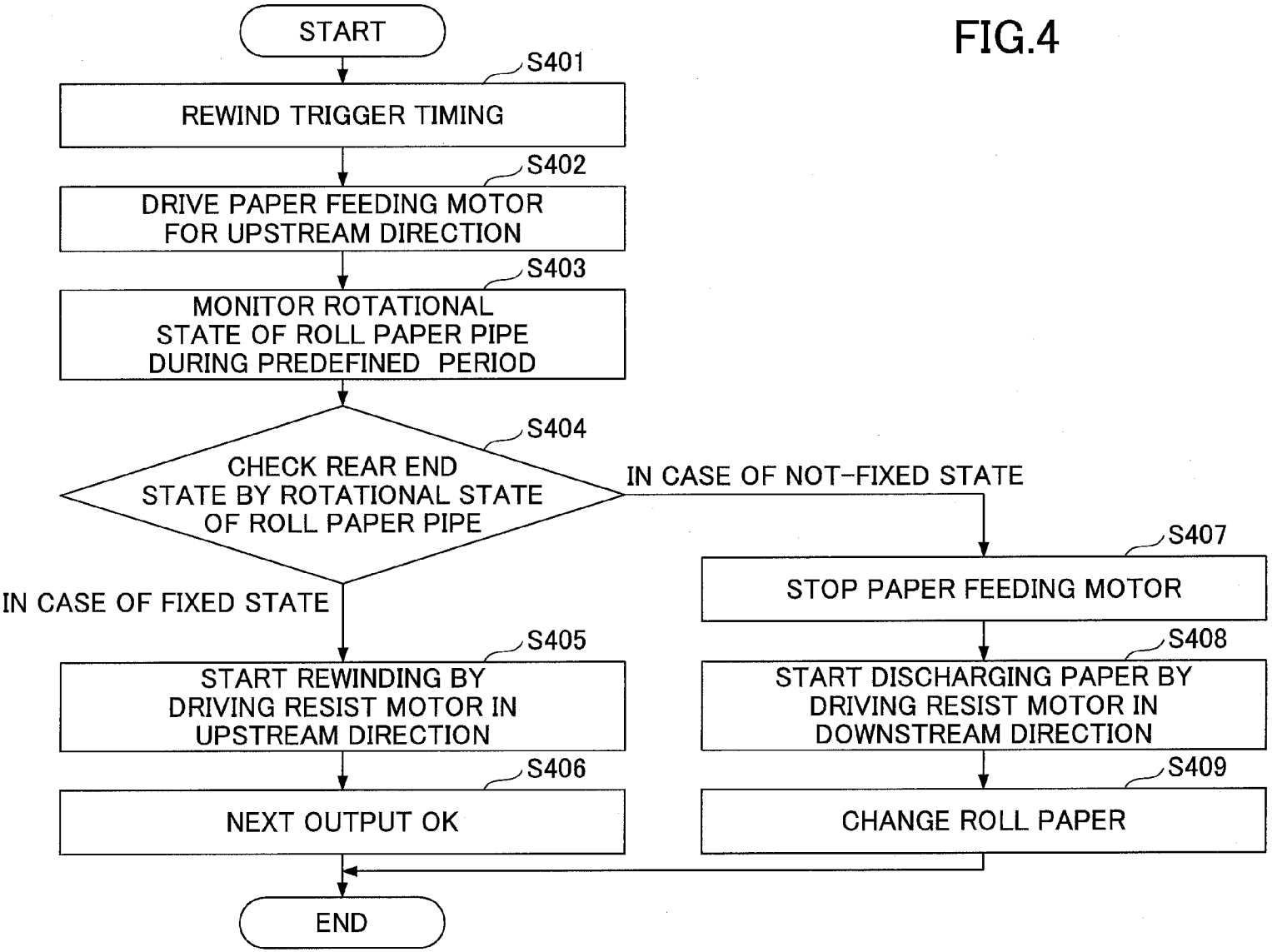
FIG. 4 is a flowchart illustrating an example of an operation of a recording medium conveyance apparatus according to a first embodiment of the present invention.

As shown in FIG. 4, the conveyance apparatus 100E, as a restoring step, in step S401, starts an operation of rewinding the roll paper MRe. The conveyance apparatus 100E starts the rewinding operation, for example, after forming an image. Also, information related to the start of the rewinding operation is inputted to the conveyance apparatus 100E by a user, for example, by using an input unit. After that, the conveyance apparatus 100E moves to step S402.

In step S402, the conveyance apparatus 100E, using the paper feeding motor 12*e*, starts moving the roll paper MRe to the upstream side in the conveyance direction. After starting the moving, the conveyance apparatus 100E moves to step S403.

In step S403, the conveyance apparatus 100E, using the detection unit 13, monitors the rotational state of the roll paper pipe 11*e*. Here, the detection unit 13, using an encoder 13*sa*, detects the rotational state of the roll paper pipe 11*e* (e.g., driving time, driving amount, etc.) during a predefined period of time (after a predefined period of time). Also, the detection unit 13 may, in the case where there are disturbances such as slack of the roll paper MRe, detect the rotational state after a predefined period of time after the start of the moving in step S402. After that, the conveyance apparatus 100E moves to step S404.

In step S404, the conveyance apparatus 100E, using the determination unit, based on a monitoring result (a detection result detected by the detection unit 13) in step S403, determines the state (accommodation state) of the rear end of the roll paper MRe of the roll paper pipe 11*e*. The conveyance apparatus 100E moves to step S405 in the case where it is determined that the state of the rear end of the roll paper MRe of the roll paper pipe 11*e* is a "fixed state". Also, the conveyance apparatus 100E moves to step S407 in the case where it is determined that the state of the rear end is a "not-fixed state".

To be more precise, the determination unit can determine the state of the rear end of the roll paper MRe as shown in the following (1) through (5).

(1) In the case where it is determined by an encoder change amount during a predefined period of time, the determination unit, by setting a threshold value as "zero", determines that the roll paper pipe 11*e* is not rotating when the encoder change amount is "zero". By this, the determination unit can determine that the rear end of the roll paper MRe is in the "fixed state" (e.g., FIG. 5A or FIG. 5C).

(2) In the case where it is determined by an encoder change amount during a predefined period of time, the determination unit, by setting a threshold value as "zero", determines that the roll paper pipe 11*e* alone is spinning around when the encoder change amount is not "zero". By this, the determination unit can determine that the rear end of the roll paper MRe is in the "not-fixed state" (e.g., FIG. 5B).

(3) In the above (1) or (2), in the case where the disturbances cannot be completely removed, the determination unit, using a threshold value other than "zero", determines the same as the above (1) or (2).

(4) In the case where it is determined by an encoder speed change during a predefined period of time, the determination unit, by setting the rotational speed of the roll paper pipe 11*e* alone when the remaining amount of the roll paper MRe is zero as a threshold value, determines that the roll paper pipe 11*e* alone is spinning around when the encoder speed change is equal to or greater than the threshold value. By this, the determination unit can determine that the rear end of the roll paper MRe is in a "not-fixed state" (e.g., FIG. 5B).

(5) In the case where it is determined by an encoder speed change during a predefined period of time, the determination unit determines that the roll paper pipe 11*e* is not rotating when the encoder speed change is less than the threshold value. By this, the determination unit can determine that the rear end of the roll paper MRe is in a "fixed state" (e.g., FIG. 5A or FIG. 5C).

In step S405, the conveyance apparatus 100E, by using the resist motor 21*e*, starts an operation of rewinding the roll paper MRe to the upstream side in the conveyance direction. After the start, the conveyance apparatus 100E moves to step S406. Note that, in order to avoid the occurrence of a jam or slack, the conveyance apparatus 100E causes the sheet line speed of the upstream side (restoring speed by the paper feeding motor 12*e*) to be greater than the sheet line speed of the downstream side in the conveyance direction (conveyance speed by the resist motor 21*e*). Also, the conveyance apparatus 100E can determine the line speed of the paper feeding motor 12*e* (rotational speed) based on the remaining amount of the roll paper MRe. Furthermore, the conveyance apparatus 100E may change the sheet line speed (change the sheet line speed without stopping, or stop and restart) as necessary.

In step S406, the conveyance apparatus 100E ends the rewinding operation. By this, the conveyance apparatus 100E stands ready for the following operations. After that, the conveyance apparatus 100E moves to "END" and ends the operation of conveying the roll paper MRe.

On the other hand, in step S407, the conveyance apparatus 100E stops the paper feeding motor 12*e*. After that, the conveyance apparatus 100E moves to step S408. That is, the conveyance apparatus 100E stops restoring the roll paper MRe onto the roll paper pipe 11*e*. Note that the conveyance apparatus 100E may move to the next step (step S408) without stopping the paper feeding motor 12*e*.

In step S408, the conveyance apparatus 100E, by using the resist motor 21*e*, discharges the roll paper MRe (to the downstream side) in the conveyance direction. After that, the conveyance apparatus 100E moves to step S409. To be more precise, in order to avoid the occurrence of a jam or slack, the conveyance apparatus 100E causes the sheet line speed of the downstream side (discharging speed of the resist roller 21*e*) to be greater than the sheet line speed of the upstream side in the conveyance direction (supplying speed of the paper supply roller 12*e*). Also, the conveyance apparatus 100E may drive the paper feeding motor 12*e* at any line speed (rotational speed). Furthermore, the conveyance apparatus 100E may cause the line speed of the paper feeding motor 12*e* to be less than the line speed of the resist motor 21*e*.

Note that the conveyance apparatus 100E may not drive the paper feeding motor 12*e*. Also, the conveyance apparatus 100E may determine whether to drive the paper feeding motor 12*e* based on a paper type, a paper thickness, etc.

In step S409, the conveyance apparatus 100E, at the end of discharging of the roll paper MRe, displays the same in the operation panel (output unit). By this, the user can recognize the timing of changing of the roll paper MRe. Note that the conveyance apparatus 100E is configured to be able to automatically feed other roll papers, etc., from other paper feeding unit. By this, the conveyance apparatus 100E can feed a new roll paper without waiting for a user to change the roll paper, and can shorten the amount of time needed for feeding a new roll paper. After that, the conveyance apparatus 100E moves to "END" in the figure and ends the operation of conveying the roll paper MRe.

Figure 5A:
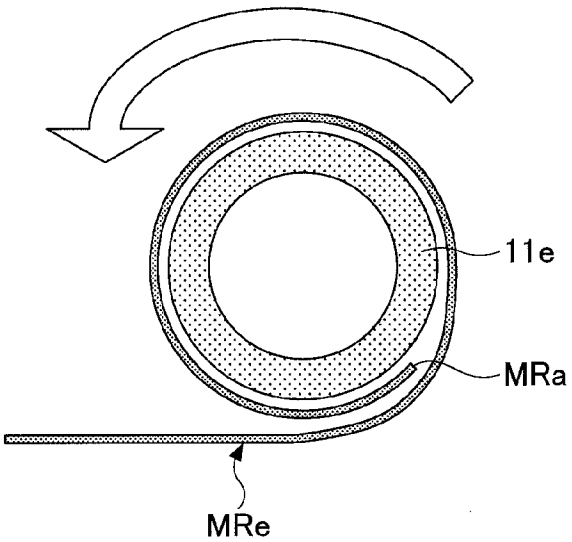
FIGS. 5A, 5B and 5C are drawings illustrating an example of a determination result determined by the recording medium conveyance apparatus according to the first embodiment of the present invention.
Figure 5B:
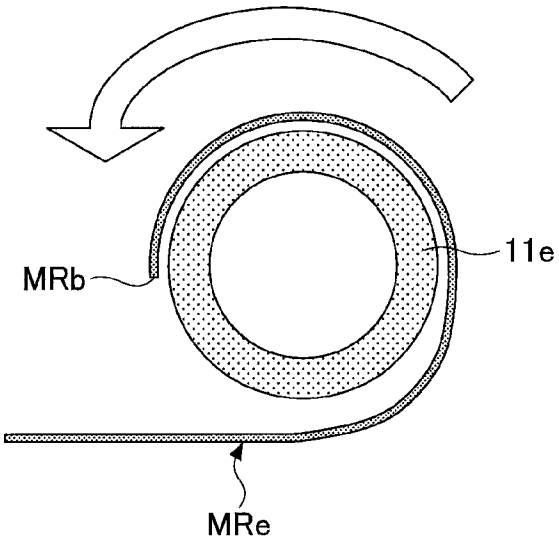
Figure 5C:
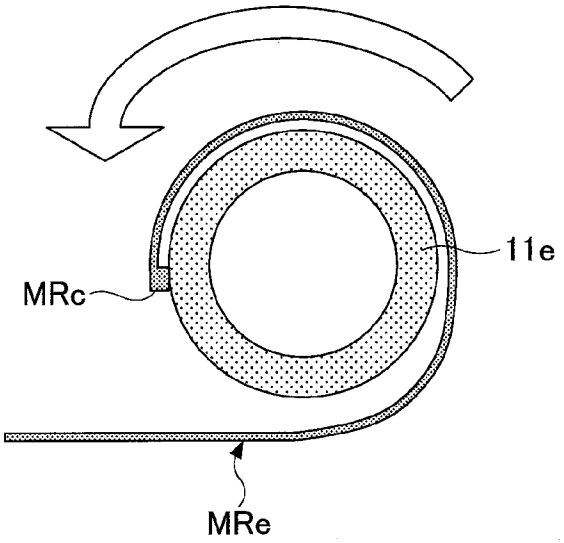

FIGS. 5A, 5B and 5C show the states of the rear end of the roll paper MRe, which states are determined by the conveyance apparatus 100E. Here, the conveyance apparatus 100E determines that the state of the rear end is a not-fixed state in the case where the roll paper pipe 11*e* rotates when the paper feeding motor 12*e* is driven in the upstream direction in a state in which the downstream side of the roll paper MRe is held still (a state in which it is not moved by an excitation of the resist motor 21*e*).

As shown in FIG. 5A, the rear end MRa of the roll paper MRe is caught between the roll paper pipe 11*e* and the downstream part of the roll paper MRe itself. That is, the state of the rear end of the roll paper MRe is a "fixed state".

As shown in FIG. 5B, the rear end MRb of the roll paper MRe is not caught between the roll paper pipe 11*e* and the downstream part of the roll paper MRe itself. That is, the state of the rear end of the roll paper MRe is a "not-fixed state".

As shown in FIG. 5C, the rear end MRc of the roll paper MRe is connected to the roll paper pipe 11*e*. That is, the state of the rear end of the roll paper MRe is a "fixed state".

As described above, the conveyance apparatus 100E of the first embodiment can obtain the same effects as the conveyance apparatus 100.

Second Embodiment

The present embodiment will be described using an image forming apparatus 200, which includes the conveyance apparatus 100, according to a second embodiment of the present invention. Here, in the present embodiment, the image forming apparatus 200 is a serial type ink-jet recording apparatus. Note that the image forming apparatus of the present embodiment is not limited to a serial type. Also, the image forming apparatus of the present embodiment is not limited to an ink-jet recording apparatus.

Configuration of the Image Forming Apparatus

Using FIG. 1 through FIG. 3, the configuration of the image forming apparatus 200 will be described. Note that because the configuration of the image forming apparatus 200 includes the configuration of the conveyance apparatus 100, things that are different from the configuration of the conveyance apparatus 100 will be mainly described.

As shown in FIG. 1, the image forming apparatus 200 of the present embodiment further includes an image forming unit 60 that forms images on the recording medium MR. Also, the image forming apparatus 200 may further include an image reading unit for reading images recorded (formed) on originals and an original conveyance unit for conveying the originals.

The image forming unit 60 is a unit for forming images on surfaces of the recording medium MR. The image forming unit 60 includes a guide rod 63 and a guide rail 64 which are placed between a pair of side plates (not shown in the figure), and a carriage 65 that is configured to be slidable with respect to the guide rod 63, etc., in a direction indicated by an arrow "A" as shown in FIG. 1.

Installed in the carriage 65 are liquid jetting heads that jet an ink drop of colors of black (K), yellow (Y), magenta (M) and cyan (C). Each of the heads may include a sub tank integrated with the head for supplying ink.

A main scanning mechanism, which moves the carriage 65 for scanning, includes a driving motor 62M configured to be placed in one side in the main scanning direction, a driving pulley 62P configured to be driven to rotate by the driving motor 62M, and a following pulley 62N configured to be placed in the other side in the main scanning direction. Also, the main scanning mechanism further includes a belt member 62B configured to be placed between the driving pulley 62P and the following pulley 62N.

The following pulley 62N, by using a tension spring (not shown in the figure), puts a tension to the belt member 62B in a direction for moving away from the driving pulley 62*p*.

The belt member 62B, by being fixed to a belt fixing unit that is included in the back side of the carriage 65, moves the carriage 65 in the main scanning direction (a direction indicated by the arrow "A").

Also, an encoder sheet (not shown in the figure) for detecting a scanning location of the carriage 65 along the main scanning direction is placed, and the encoder sheet is read by an encoder sensor (not shown in the figure) included in the carriage 65.

In a recording area of the scanning area of the carriage 65, the roll paper MRe is conveyed by a sheet suction conveyance unit 67 intermittently in a direction (sub-scanning direction: direction indicated by an arrow "B") orthogonal to the scanning direction of the carriage 65. Also, in an area of an end of the main scanning area, a maintenance and restoration mechanism 68 for maintenance and restoration of the recording heads is placed. Furthermore, a main cartridge 69 for containing each of the colors of ink for supplying to the sub tanks of the recording heads is installed detachably outside the carriage moving area in the main scanning direction or in an area of the other end of the main scanning area.

The image forming apparatus 200, by using the conveyance unit 20 (roller pair 21*c*, resist roller 21*a* and the pressurized roller 21*b*, etc.), conveys the roll paper MRe fed by a roll paper accommodation unit (feeding unit 10) to a recording area in a direction from the rear to the front of the image forming apparatus 200.

Also, the image forming apparatus 200, while moving the carriage 65 in the main scanning direction and conveying the roll paper MRe intermittently using the resist roller 21*a* and the pressurized roller 21*b*, drives the recording heads according to image information. At this time, the image forming apparatus 200 forms certain images on the roll paper MRe by jetting liquid drops (ink) from the recording heads.

Furthermore, the image forming apparatus 200 cuts the image formed roll paper MRe in a predefined length and discharges it into a copy receiving tray (not shown in the figure) configured to be placed in the front side of the image forming apparatus 200. At this time, the image forming apparatus 200, after conveying (rewinding) the part of the roll paper MRe, for the next image forming, to the resist roller 21*a* and the pressurized roller 21*b*, releases a nip of the roller pair 21*c*.

Functions of the Image Forming Apparatus

Using FIG. 6, functions of the image forming apparatus 200 will be described.

Figure 6:
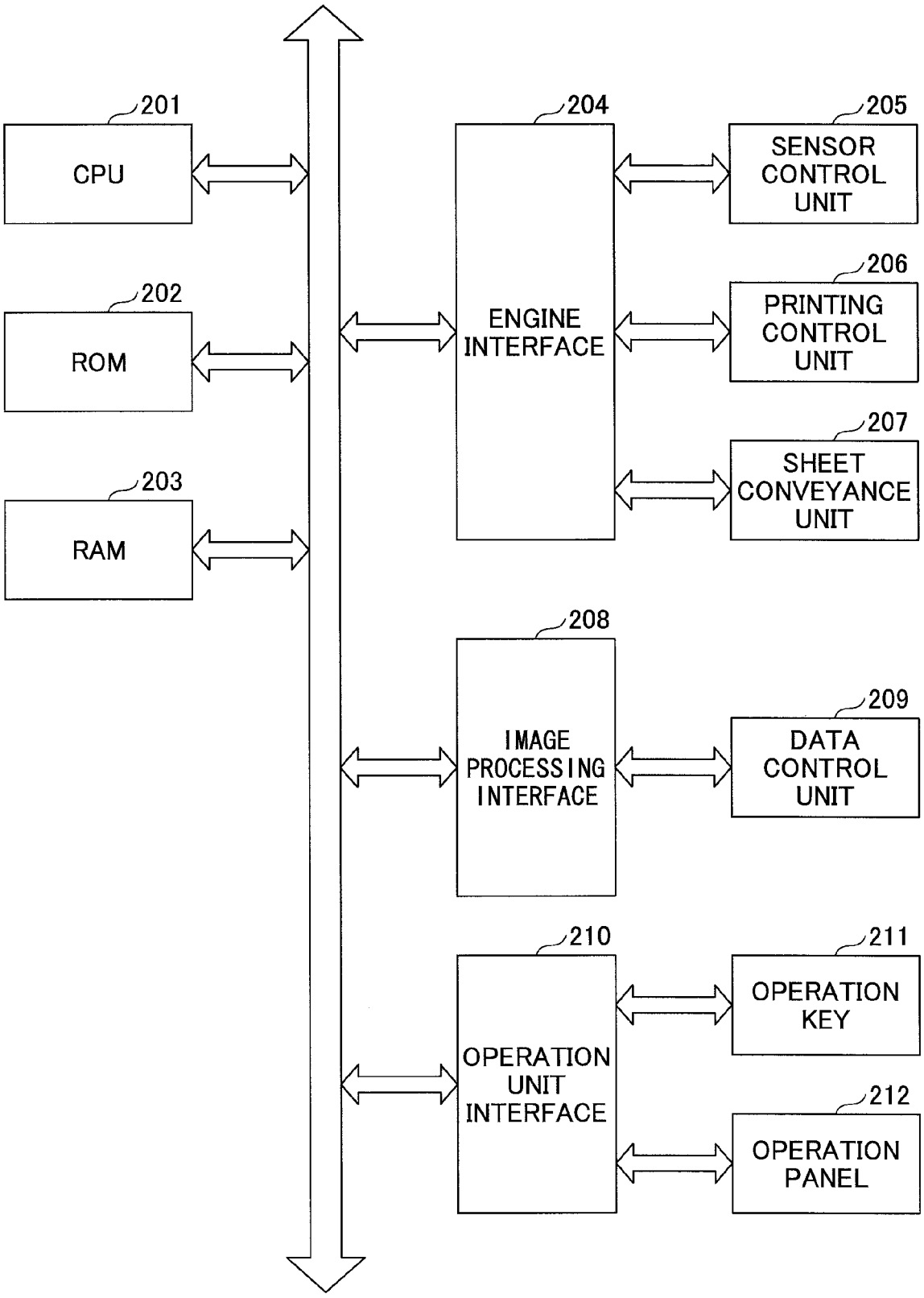
FIG. 6 is a functional block diagram illustrating an example of a function of an image forming apparatus according to a second embodiment of the present invention.

As shown in FIG. 6, the image forming apparatus 200 includes, as a control unit, a CPU 201, a ROM 202, a RAM 203, an engine interface 204, a sensor control unit 205, a printing control unit 206, a sheet conveyance unit 207, an image processing interface 208, a data control unit 209 and an operation unit interface 210. Also, the image forming apparatus 200 includes, as an input unit and an output unit, an operation key 211 and an operation panel 212.

The CPU (Central Processing Unit) 201 is used as a central processing unit of the image forming apparatus 200. The CPU 201 provides various functions by reading and executing an OS or programs from a memory device (e.g., a ROM that will be described later). Also, the CPU 201 performs logical calculations, etc., using control programs stored in the ROM 202 and performs the controlling of each of the units, the calculating and editing of data, etc.

The ROM (Read Only Memory) 202 stores control programs, operational conditions, etc. Note that the image forming apparatus 200 may use, other than the ROM, a device or a medium that can store data (e.g., a USB memory, a SD card memory, a DVD-ROM, a CD-ROM).

The RAM (Random Access Memory) 203 is a work memory (cache memory) in which data necessary at the execution of program is stored temporarily. The RAM 203 is used as a work area in the case where the CPU 201 performs logical calculations, etc. The RAM 203 performs read and write operations of variable data used for logical calculations of the control programs.

The engine interface 204 performs interface processes of control units that will be described later. The engine interface 204 is connected to the sensor control unit 205, the printing control unit 206 and the sheet conveyance unit 207.

The sensor control unit 205 controls operations of various types of sensors. The sensor control unit 205 is connected to a conveyance sensor or an encoder sensor, etc. Also, the sensor control unit 205 performs the inputting and the digitization of sensor information of the connected conveyance sensor or the encoder sensor, etc. The printing control unit 206 controls operations of the image forming unit 60. The sheet conveyance unit 207 controls operations of the paper feeding roller (roller pair 21*c*) in FIG. 2 and the resist roller (21*a*) in FIG. 2.

The image processing interface 208 performs interface processes of the data control unit 209. The data control unit 209 performs the writing and the reading of printing data and image quality data, that are read as digital data, to and from the memory device such as a hard disk, etc.

The operation unit interface 210 performs interface processes of the input unit and the output unit (e.g., operation key 211 and operation panel 212). The operation key 211 is a key for the input operation by an operator (user). The operation panel 212 displays a status report or a setting status report of the image forming apparatus 200 using a display unit (e.g., a LCD or a LED device).

Recording Medium Conveyance Operations of the Image Forming Apparatus

Because operations of the image forming apparatus 200 for conveying the recording medium MR is basically the same as the ones of the conveyance apparatus 100, the description of the operations is omitted.

According to the image forming apparatus 200 of the second embodiment described above, in the conveyance of the recording medium MR, the same effects as the conveyance apparatus 100 can be obtained.

Embodiments of the recording medium conveyance apparatus and the image forming apparatus have been described.

Further, the present invention is not limited to these embodiments, but various variations and modifications may be made without departing from the scope of the present invention.

The present application is based on and claims the benefit of priority of Japanese Priority Application No. 2012-240240 filed on Oct. 31, 2012 with the Japanese Patent Office, the entire contents of which are hereby incorporated by reference.

What is claimed is:

1. A recording medium conveyance apparatus for conveying a recording medium rolled around a roll pipe, the recording medium conveyance apparatus comprising:

a driving unit configured to drive the roll pipe;

a detection unit configured to detect a rotational operation of the roll pipe;

a conveyance unit configured to convey the recording medium and settable to fix the recording medium pulled out from the roll pipe by nipping the recording medium with at least two rollers;

a determination unit configured to determine that the recording medium is not fixed to the roll pipe when the detection unit detects more than a number of rotations, and to determine that the recording medium is fixed to the roll pipe when the detection unit does not detect more than said number of rotations, when the recording unit is fixed by the at least two rollers and the driving unit drives the roll pipe in a direction for rewinding the recording medium.

2. The recording medium conveyance apparatus as claimed in claim 1, wherein the driving unit includes a clutch member for transmitting power to the roll pipe, and the clutch member transmits the power in a case where the roll pipe can be driven with a power equal to or less than a predefined amount of power and does not transmit the power in a case where the roll pipe cannot be driven with a power equal to or less than the predefined amount of power.

3. The recording medium conveyance apparatus as claimed in claim 1, wherein the detection unit, in a case where the recording medium is fixedly held by the rollers, detects the rotational operation of the roll pipe when the driving unit reversely rotates the roll pipe to restore the recording medium.

4. The recording medium conveyance apparatus as claimed in claim 1, wherein the detection unit detects the rotational operation of the roll pipe after a predefined period of time after the driving unit starts driving the roll pipe for rolling back the recording medium on the roll pipe.

5. The recording medium conveyance apparatus as claimed in claim 1, wherein the determination unit, when a number of rotations of the roll pipe is less than a predefined number of rotations in the rotational operation of the roll pipe detected by the detection unit, determines that the recording medium is fixed to the roll pipe.

6. The recording medium conveyance apparatus as claimed in claim 4, further comprising:

an input unit configured to input the predefined period of time.

7. The recording medium conveyance apparatus as claimed in claim 1, wherein the feeding unit, in a case where the determination unit determines that the recording medium is fixed to the roll pipe, causes a speed of restoring the recording medium by rotating the roll pipe by the driving unit to be greater than a speed of conveying the recording medium by rotating the rollers by the conveyance unit.

8. The recording medium conveyance apparatus as claimed in claim 1, wherein the conveyance unit, in a case where the determination unit determines that the recording medium is not fixed to the roll pipe, causes a speed of conveying the recording medium by rotating the rollers by the conveyance unit to be greater than a speed of restoring the recording medium by rotating the roll pipe by the driving unit.

9. The recording medium conveyance apparatus as claimed in claim 1, wherein the conveyance unit discharges the recording medium by rotating the rollers in a forward direction in response to a determination that the recording medium is not fixed to the roll pipe.

10. The recording medium conveyance apparatus as claimed in claim 1, further comprising:

an output unit configured to output a conveyance result of the recording medium as the conveyance unit rotates the rollers in a forward direction to discharge the recording medium.

11. An image forming apparatus including the recording medium conveyance apparatus as claimed in claim 1 and an image forming unit configured to form images on the recording medium.

12. A recording medium conveyance method comprising:

driving a roll pipe having a recording medium rolled thereon;

detecting a rotational state of the roll pipe;

nipping the recording medium with at least two rollers to convey the recording medium pulled out from the roll pipe;

determining that the recording medium is not fixed to the roll pipe when more than a number of rotations is detected and determining that the recording medium is fixed to the roll pipe when more than said number of rotations is not detected while the recording medium is held in a fixed position by the at least two rollers and the roll pipe is driven in a direction for rewinding the recording medium on the roll pipe.

13. A non-transitory computer readable recording medium in which a program for causing a computer to execute the recording medium conveyance method as claimed in claim 12 is recorded.

14. The recording medium conveyance apparatus as claimed in claim 5, further comprising:

an input unit configured to input the predefined number of rotations.

* * * * *